US010238186B2

(12) United States Patent
Ly

(10) Patent No.: US 10,238,186 B2
(45) Date of Patent: Mar. 26, 2019

(54) CURVED SLIDE FASTENERS AND RELATED SYSTEMS

(71) Applicant: THE NORTH FACE APPAREL CORP., Wilmington, DE (US)

(72) Inventor: John Ly, Alameda, CA (US)

(73) Assignee: The North Face Apparel Corp., Wilmington, DE (US)

( * ) Notice: Subject to any disclaimer, the term of this patent is extended or adjusted under 35 U.S.C. 154(b) by 8 days.

(21) Appl. No.: 15/393,060

(22) Filed: Dec. 28, 2016

(65) Prior Publication Data

US 2017/0231332 A1 Aug. 17, 2017

Related U.S. Application Data

(60) Provisional application No. 62/274,085, filed on Dec. 31, 2015.

(51) Int. Cl.
*A44B 19/34* (2006.01)
*A44B 19/02* (2006.01)

(52) U.S. Cl.
CPC ..... *A44B 19/346* (2013.01); *A44B 19/02* (2013.01); *A44B 19/343* (2013.01)

(58) Field of Classification Search
CPC ..... A44B 19/346
See application file for complete search history.

(56) References Cited

U.S. PATENT DOCUMENTS 2,296,358 A * 9/1942 Marinsky ..... E04H 15/32 135/119
4,308,645 A * 1/1982 Hasegawa ..... A44B 19/38 24/404
5,172,456 A * 12/1992 Samberg ..... A44B 19/346 24/397
8,011,070 B2 * 9/2011 Miyazaki ..... A44B 19/343 139/384 B
9,601,034 B2 * 3/2017 Jensen ..... G09F 3/00
2006/0042732 A1 * 3/2006 Oh ..... A45C 3/04 150/107

(Continued)

FOREIGN PATENT DOCUMENTS

CN 201782133 U 4/2011
DE 7122407 U 9/1971

OTHER PUBLICATIONS

International Search Report and Written Opinion of the International Searching Authority dated Mar. 23, 2017 in International Application No. PCT/US16/69002.

*Primary Examiner* — Jason W San
(74) *Attorney, Agent, or Firm* — Ganz Pollard, LLC

(57) ABSTRACT

Woven and knit substrates having juxtaposed notches with finished edges are disclosed. Such substrates can be used as opposed fastener tapes and fastener elements can be formed, woven, or otherwise added to the opposed fastener tapes in a known fashion. The notched fastener tapes permit the resulting slide fastener to be curved in-plane without buckling either of the opposed the fastener tapes out-of-plane. The finished edges maintain structural integrity of the woven or knit substrates, in stark context to prior art substrates having cut notches. Also disclosed are panelized substrates having curved apertures and incorporating disclosed slide fasteners.

16 Claims, 4 Drawing Sheets

(56) References Cited

U.S. PATENT DOCUMENTS

2008/0209694 A1* 9/2008 Horikawa ..... A44B 19/346 24/381
2008/0289156 A1* 11/2008 Lewis ..... A44B 19/346 24/381
2009/0293198 A1* 12/2009 Fodge ..... A47C 31/10 5/653
2011/0030746 A1* 2/2011 Uniyal ..... A45B 25/24 135/34.2
2012/0024850 A1* 2/2012 Mazzan ..... A45C 13/06 220/200
2012/0151654 A1* 6/2012 Chopak ..... A41B 13/06 2/69.5
2012/0255120 A1* 10/2012 Poston ..... A47C 31/105 5/499
2013/0174388 A1* 7/2013 Ren ..... A44B 19/04 24/427
2013/0177734 A1* 7/2013 Hasegawa ..... A44B 19/346 428/99
2013/0185903 A1* 7/2013 Matsuzawa ..... A44B 19/346 24/415
2013/0205548 A1* 8/2013 Wehner ..... A41H 37/003 24/381
2013/0232737 A1* 9/2013 Shimono ..... A44B 19/04 24/427
2013/0298358 A1* 11/2013 Nishida ..... A44B 19/346 24/393
2014/0007457 A1* 1/2014 Jones ..... A43C 1/00 36/50.1
2015/0000087 A1* 1/2015 Tanaka ..... A44B 19/34 24/389
2015/0272285 A1* 10/2015 Tang ..... A44B 19/403 139/384 B
2015/0366300 A1* 12/2015 Sho ..... A44B 19/12 24/393
2015/0366313 A1* 12/2015 Hsu ..... A45C 5/03 24/30.5 L
2016/0081437 A1* 3/2016 Davis ..... A47C 31/105 5/488
2016/0183641 A1* 6/2016 Honour ..... A44B 19/403 24/409

* cited by examiner

CURVED SLIDE FASTENERS AND RELATED SYSTEMS

BACKGROUND

The innovations and related subject matter disclosed herein (collectively referred to as the "disclosure") generally pertain to planar substrates and related systems, and more particularly but not exclusively, to curved substrates lying in a selected plane, with woven or knit substrates suitable for curved slide fasteners in which a wrinkle or wavy uneven surface on the substrate is reduced or eliminated being but particular examples of disclosed planar substrates.

A slide fastener can be attached to an apertured panel, as to open and close an opening portion of a bag, the front of clothes, and/or a trouser fly. A curved slide fastener, in which a fastener tape (or substrate) thereof is curved at a predetermined curvature along a longitudinal axis of the slide fastener in a horizontal direction (e.g., "in plane") with respect to a major surface (e.g., the tape surface) thereof, is sometimes desirable to open and close a curved opening. Conventionally, warp yarns of a fastener tape running linearly (e.g., longitudinally) in parallel with each other in a weaving direction or a knitting direction are substantially inelastic. Thus, adjusting yarn tension in the weaving direction or the knitting direction of a conventional fastener tape, as by attempting to bend or curve the fastener tape horizontally with respect to the tape surface, causes one or more of the warp yarns (e.g., radially inward warp yarns) to buckle, causing a wavy surface extending out of plane relative to the planar surface of an undeflected, at-rest fastener tape.

With conventional, curved, slide fasteners, a plurality of juxtaposed notches arranged lengthwise (e.g., longitudinally) of the linear substrate have been cut into the substrate to overcome such buckling. FIGS. 1 and 2 show an example of a conventional substrate for a curved slide fastener disclosed in German Pat. DE7122407U having notches 5 and 6. However, such post-production notching increases costs and reduces reliability of the substrate as conventionally knit or woven yarns are cut, substantially weakening the substrate and thus the slide fastener. For example, free-cut yarns can cause the substrate to fray.

Thus, a need exists for substrates suitable for curved slide fasteners (e.g., zippers) that do not require post-production notching of the substrate. As well, a need remains for notched substrates that lack free, cut ends of yarns.

SUMMARY

The innovative substrates and related innovations disclosed herein overcome problems in the prior art and address one or more of the aforementioned, or other, needs.

For example, woven and knit substrates having juxtaposed notches with finished edges are disclosed. Such substrates can be used as opposed, fastener-tapes and fastener elements can be formed, woven, or otherwise added to the opposed fastener tapes in a known fashion. The notched fastener tapes permit the resulting slide fastener to be curved in-plane without buckling either of the opposed the fastener tapes out-of-plane. Moreover, the finished edges maintain structural integrity of disclosed woven and knit substrates, in stark contrast to prior art substrates having cut notches.

These and other embodiments are described in more detail in the following detailed descriptions and the drawings. It is to be understood that other innovative aspects will become readily apparent to those skilled in the art from the following detailed description, wherein various embodiments are shown and described by way of illustration. As will be realized, other and different embodiments are possible and several details are capable of modification in various other respects, all without departing from the spirit and scope of the principles disclosed herein.

Accordingly, the drawings and detailed description are to be regarded as illustrative in nature and not as restrictive. The appended claims, as originally filed in this document, or as subsequently amended, are hereby incorporated into this Summary section as if written directly herein.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several aspects of the presently disclosed principles are illustrated by way of example, and not by way of limitation, in detail in the drawings, wherein.

DETAILED DESCRIPTION

By way of reference to specific examples, the following describes various innovative principles related to planar substrates, and more particularly but not exclusively to knit and woven substrates formed with notches suitable for use with curved slide fasteners.

One or more of the disclosed principles can be incorporated in various system configurations to achieve any of a variety of corresponding system characteristics. The detailed description set forth below in connection with the appended drawings is intended as a description of various embodiments of disclosed principles and is not intended to represent the only embodiments contemplated by the inventor. Moreover, the detailed description includes specific details for the purpose of providing a comprehensive understanding of the principles disclosed herein. However, it will be apparent to those of ordinary skill in the art after reviewing this disclosure that one or more of the claimed inventions may be practiced without one or more of the illustrated details and/or in conjunction with details not expressly illustrated or described herein.

Stated differently, systems described in relation to particular configurations, applications, or uses, are merely examples of systems incorporating one or more of the innovative principles disclosed herein and are used to illustrate one or more innovative aspects of the disclosed principles. Thus, slide-fastener systems having attributes that are different from those specific examples discussed herein can embody one or more of the innovative principles, and can be used in applications not described herein in detail. Accordingly, such alternative embodiments also fall within the scope of this disclosure, as will be appreciated by those of ordinary skill in the art following a review of this disclosure.

Figure 1:
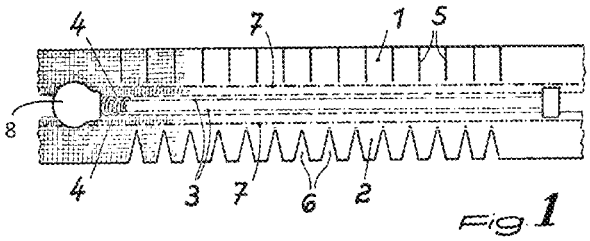
FIG. 1 shows a prior art slide fastener having notched substrates.
Figure 2:
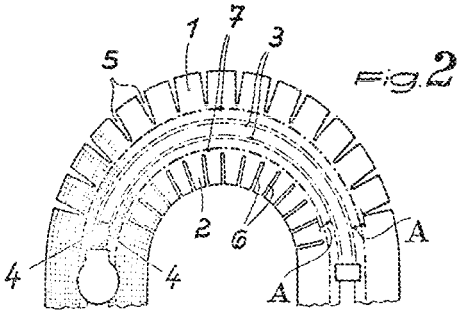
Fig. 2 PRIOR ART
FIG. 2 shows the slide fastener shown in FIG. 1 after bending.

As shown in FIGS. 1 and 2, a curved slide fastener can have a pair of opposed fastener tapes 4, each having a corresponding row of fastener elements 3. A slider 8 can be configured to urge disengaged-but-opposed fastener elements 3 together in a mating engagement or to urge matingly engaged fastener elements 3 apart as the slider 8 slides to and fro. The juxtaposed notches 5 and 6 permit the fastener, and more particularly, the notched fastener tapes 4, to bend in the plane of the fastener tapes 4 without causing the fastener tape substrates to buckle or otherwise deform out of plane, as shown in FIG. 2.

However, in the prior-art device shown in FIGS. 1 and 2, the warp- and/or weft-yarns within the illustrated fastener tapes 4 are cut to form the several notches 5, 6. As a consequence of segmenting the knit or wove fastener tapes 4 by cutting, the structural integrity of the woven or knit structure is substantially diminished and the resulting tails of the woven or knit structure can fray over time, further reducing the structural integrity of the substrate. Accordingly, over time, the prior-art device shown in FIGS. 1 and 2 can delaminate from a substrate panel to which it has been affixed (e.g., by adhesive, stitching, or other known technique) as the woven or knit structure frays.

Figure 3:
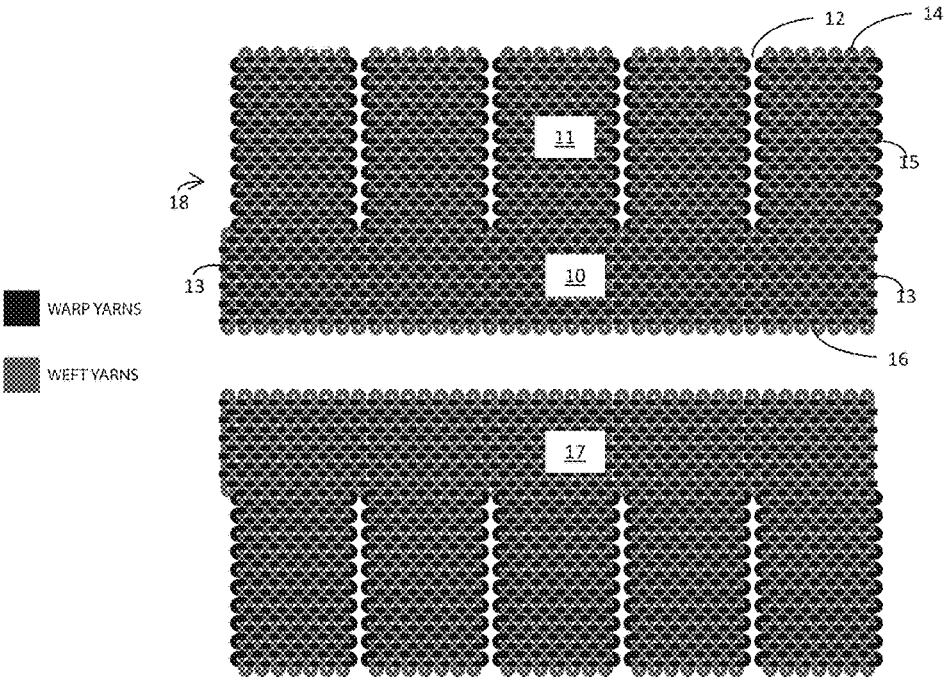
FIG. 3 shows a woven substrate having woven notches with finished edges.

FIG. 3 depicts a pair of opposed woven substrates 10, 17. Each substrate has been woven in a manner to form a plurality of longitudinally juxtaposed panel segments 11 extending laterally outward of a continuous panel segment 13 extending in a weaving (longitudinal) direction. The panel segments 11 are separated from each other by notches 12 positioned therebetween during weaving, yielding a finished perimeter edge 14, 15 extending around an outer periphery of each panel segment 11. As a consequence, notched substrates as presently disclosed lack tails and will not fray as with conventional cut substrates described above. Accordingly, disclosed substrates and slide fasteners incorporating such disclosed substrates are substantially less likely as compared to prior fastener tapes to delaminate or otherwise fail when affixed to a substrate panel.

As shown in FIG. 3, the warp yarns of each panel segment 11 are relatively short compared to the warp yarns within the continuous panel segment 13 and extend only the length of the respective panel segment in the weaving (or longitudinal) direction. Thus, the substrate shown in FIG. 3 has a plurality of continuous warp yarns positioned laterally adjacent each other to form the continuous panel segment 13, and a set of plural warp yarns positioned laterally adjacent to each other and corresponding to each panel segment 11 (referred to as "panel warp-yarns"). The several warp-yarns in each set of panel warp-yarns are positioned laterally adjacent to each other and extend in the weaving direction parallel to the continuous warp yarns. Additionally, each set of panel warp-yarns is longitudinally spaced apart from one or more adjacent sets of panel warp-yarns. The spacing, or gaps, between adjacent sets of panel warp-yarns defines the space and the shape of the resulting notches 12.

For example, the panel warp-yarns in a given set of panel warp-yarns can have a uniform, fixed length regardless of their respective lateral positions relative to adjacent panel warp-yarns. Such an arrangement yields a laterally extending straight edge 18 along the corresponding panel segment 11. Alternatively, adjacent panel warp-yarns can differ in length to provide a correspondingly different contour of the edge 18 along the corresponding panel segment. For example, adjacent panel warp-yarns can continuously taper in length in correspondence to each respective warp-yarn's position laterally outward of the continuous panel segment 13. Such a tapering length of the warp-yarns (and thus the panel segment 11) can provide a wedge-shaped notch having a relatively larger gap at a laterally outer-most position (e.g., laterally distal from the continuous segment 13) and a relatively narrower gap at a laterally inner-most position (e.g., laterally proximal to the continuous segment 13), as with the notches 6 depicted in FIG. 1. However, in contrast to the notches 6 shown in FIG. 1, notches of disclosed fastener tapes have finished edges to maintain the structural integrity of the fastener tape.

An approach for forming such a fastener tape is described. After tensioning the continuous warp yarns and the several sets of panel warp-yarns, the weft yarns can be woven over and under the several warp yarns in a desired fashion. As the shuttle or other member used to weave the weft yarns over and under the warp yarns reaches a notched region (e.g., a warp yarn corresponding to a laterally outermost extent of the continuous panel segment 13), the shuttle can return to the edge 16. In the regions having the panel warp-yarns, the shuttle with the weft yarns can continue across the panel, e.g., to the edge 14. To finish the edges 14, 15, and 16, any tails of the warp yarns or the weft yarns can be woven into the substrate in a known manner to create a finished edge, as will be appreciated by those of ordinary skill in the art. Such a finished edge will be substantially less likely to fray or otherwise deteriorate compared to a "live-edge" formed by cutting or otherwise segmenting continuous warp yarns, as with prior approaches for notching substrates.

As indicated in FIG. 3, a pair of substrates of the type just described can be positioned in an opposed relationship to each other to form opposed fastener tapes 10, 17. Fastener elements 3 can be formed or woven into the opposed continuous edges 16, and a slider 8 can be engaged with the fastener tapes in a known manner. Once the slide fastener is assembled as just described, the notched fastener tapes 10, 17 permit the slide fastener to be bent or curved in plane with no buckling or other out-of-plane deformation of either fastener tape 10, 17.

Figure 4:
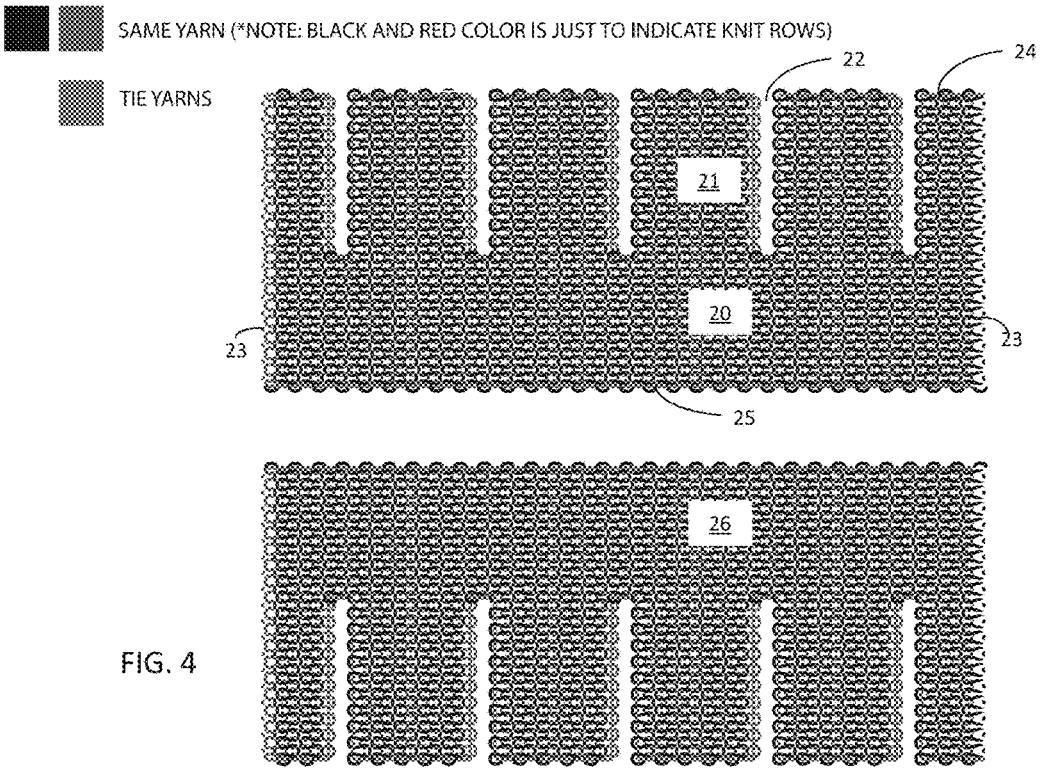
FIG. 4 shows a knit substrate having notches with finished edges.

Turning now to FIG. 4, a notched substrate 20 with finished edges formed by knitting will now be described. As with the woven substrate 10, the knit substrate 20 has a plurality of juxtaposed panel segments 21 separated from each other by gaps formed by notches 22. The knit substrate 20 has finished edges 24 extending around the exposed edges of the panel segments 21, as well as a continuous finished edge 25 extending in a knit direction. A length of each woven row is determined according to whether the row will terminate on, e.g., a distal edge 24 of, a given panel segment 21, or whether the row will terminate laterally inward of the distal edge, e.g., at a proximal edge of a notch 22. At each terminal end of a knit row, a tie thread is used to finish the row and to provide a finished edge spanning the knit rows. Notches of various shapes are possible with a knitted construct. For example, each knit row can terminate at a selected position between an innermost edge of a notch (corresponding to an outermost edge of a knitted continuous panel segment) and an outermost edge 25 of the panel segment 21.

As indicated in FIG. 4, a pair of substrates of the type just described can be positioned in an opposed relationship to each other to form opposed fastener tapes 20, 26. Fastener elements 3 can be formed or woven into the opposed continuous edges 25 and a slider 8 can be engaged with the fastener tapes in a known manner. Once the slide fastener is assembled as just described, the notched fastener tapes 20, 26 permit the slide fastener to be bent or curved in plane with no buckling or other out-of-plane deformation of either fastener tape 20, 26.

Figure 5A:
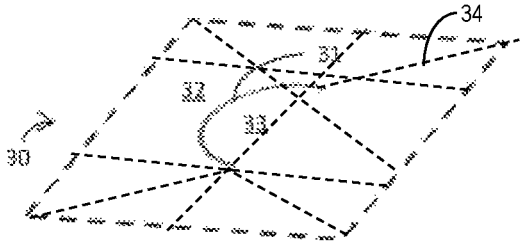
FIGS. 5A and 5B show a substrate having a curved aperture therethrough.
Figure 5B:
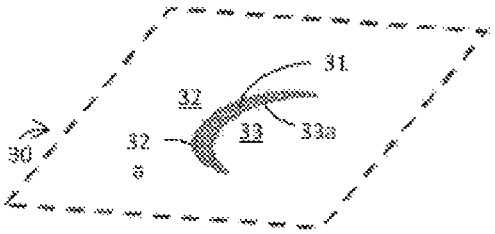

Referring now to FIGS. 5A and 5B, slide fasteners as disclosed herein can be affixed to one or more panels 32,33 defining a curved aperture 31 through a given substrate 30. For example, a curved aperture 31 can be defined between opposed and correspondingly configured first and second panel edges 32*a*, 33*a* within a substrate 30.

The substrate can be formed from a continuous panel or can be formed by an assembly of panels. A panel can be a knit, woven, or felted textile, or can be any other panelized material or fabric. But two representative examples of materials suitable for panelization include polyurethane and neoprene. A panel can have a homogeneous construction or a non-homogeneous construction. For example, a given panel can include a plurality of laminated layers of different materials. In a substrate formed from a plurality of panels, the aperture 31 can span one or more seams, e.g., one or more of the seams indicated by dotted lines 34, between or among the several panels.

Substrates as described herein can be incorporated in a variety of different garments, sporting goods, luggage items, furniture items, footwear, etc. that desirably incorporate a reversibly closeable, curved aperture. Representative garments include inner and outerwear. For example, some chest pockets or shoulder pockets incorporated in an outer garment, e.g., a ski jacket, desirably have a curved and closeable opening. A disclosed, curved slide fastener can be affixed to opposed edges of the opening, allowing the pocket to be opened and closed, while avoiding buckling of the slide fastener and/or the substrate in a region adjacent the opening. Representative sporting goods include, by way of example, tents, canopies and backpacks. Representative luggage items include, for example, suitcases, toiletry bags, duffel bags, etc. Furniture items include many types of chairs, couches, mattresses, etc., having a permanently installed or a removable cover.

Figure 6:
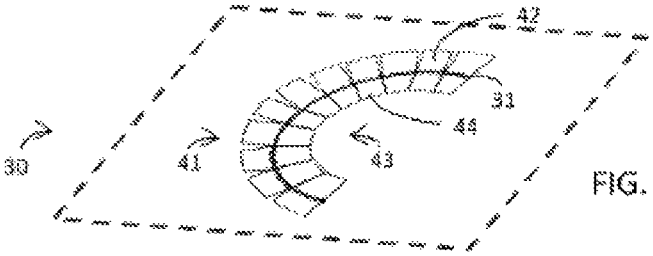
FIG. 6 shows a curved slide-fastener of the time described herein affixed to a substrate of the type shown in FIGS. 5A and 5B.

As shown in FIG. 6, slide fasteners as described above can be affixed to the opposed edges 32*a*, 33*a* of the substrate 30. More particularly, but not exclusively, each of the panel segments 42, 44 corresponding to the fastener tapes 41, 43, respectively, of a disclosed slide fastener can be affixed (e.g., sewn, glued, riveted, or otherwise attached) to a corresponding panel 32, 33 of the substrate 30. With such an arrangement, the fastener elements associated with each of the fastener tapes 41, 43 can be positioned above or slightly laterally inward of the opposed edges defining the aperture 31. Accordingly, when the slide (not shown) urges the opposed fastener elements of the respective fastener tapes into a mating engagement with each other, the opposed fastener tapes urge the panels 32, 33 toward each other to close the aperture 31. FIG. 5A shows the aperture 31 in a closed position, while in FIG. 5B, the aperture 31 is shown in an open position. Stated differently, the panels 32, 33 are spaced apart from each other in FIG. 5B to define a gap therebetween.

As shown in FIG. 6, gaps between adjacent panel segments 44 permit the fastener tape 43 to convexly bend in plane without buckling. Similarly, the notches, or gaps, between each of the panel segments 42 corresponding to the other fastener tape 41 permit the fastener tape to concavely bend, which expands the notches but does not cause the fastener tape 41 to buckle or to tear.

Each of the panel segments 42, 44 can be affixed to a corresponding region of the respective panel 32, 33. As described above, a slider 8 can be slidingly engaged with the fastener tapes 41, 43 to urge opposed fastener elements of the tapes 41, 43 into a mating engagement with each other or to disengage a mating engagement therebewteen as the slider moves longitudinally to and fro along the fastener tapes 41, 43.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

For example, although the curved apertures depicted in FIGS. 5A, 5B, and 6 have a substantially constant curvature, apertures having a variable curvature, including one or more curvature inflection points, are contemplated. A representative example of an aperture having a curvature inflection point includes an "S" shaped aperture. Disclosed slide fasteners are suitable for use in connection with apertures having such variable-curvature.

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The previous description of the disclosed embodiments is provided to enable any persons of ordinary skill in the art to make or use the disclosed innovations. Various modifications to those embodiments will be readily apparent to those skilled in the art, and the generic principles defined herein may be applied to other embodiments without departing from the spirit or scope of this disclosure. Thus, the disclosed inventions are not intended to be limited to the embodiments shown herein, but are to be accorded the full scope consistent with the language of this disclosure, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No element is to be construed under the provisions of 35 USC 112, sixth paragraph, unless the element is expressly recited using the phrase "means for" or "step for".

Thus, in view of the many possible embodiments to which the disclosed principles can be applied, it should be recognized that the above-described embodiments are only examples and should not be taken as limiting in scope. I therefore reserve all rights to the subject matter disclosed herein, including the right to claim any and all combinations of subject matter described herein, including but not limited to all that comes within the scope and spirit of the following claims.

I currently claim:

1. A substrate, comprising:

opposed first and second panels, wherein a curved aperture extends through the substrate at a position between the first panel and the second panel;

a curved slide fastener having a pair of opposed, segmented substrates defining respective pluralities of juxtaposed panel segments, wherein each of the juxtaposed panel segments corresponding to one of the segmented substrates is affixed to a corresponding one of the first and the second panels, wherein each of the juxtaposed panel segments corresponding to the other of the segmented substrates is affixed to the other of the first and the second panels, wherein each of the juxtaposed panel segments defines one or more corresponding peripheral edges that are formed and finished during a forming of the opposed, segmented substrates such that each peripheral edge lacks any tails, and wherein the slide fastener has a plurality of matingly engageable fastener elements and a slide configured to urge the fastener elements into a mating engagement with each other and to urge matingly engaged fastener elements apart from each other.

2. The substrate according to claim 1, wherein the opposed first and second panels constitute respective portions of a single construct.

3. The substrate according to claim 1, wherein the first panel constitutes a portion of a first construct and the second panel constitutes a portion of a second construct, wherein the first construct and the second construct are joined together at a seam.

4. The substrate according to claim 1, wherein the curved aperture extends from a first terminal end to a second terminal end, wherein a curvature of the aperture varies between the first terminal end and the second terminal end.

5. The substrate according to claim 4, wherein the curved aperture defines an inflection point between the first terminal end and the second terminal end.

6. The substrate according to claim 1, wherein each of the segmented substrates of the curved slide fastener comprises a woven construct.

7. The substrate according to claim 6, wherein each panel segment in each respective segmented substrate defines a first finished edge and an opposed second finished edge and comprises a corresponding plurality of panel warp-yarns extending longitudinally from the first finished edge of the respective panel segment to the opposed second finished edge of the panel segment.

8. The substrate according to claim 7, wherein each of the panel warp-yarns in a selected panel segment has an equivalent length compared to the other panel warp-yarns in the selected panel segment.

9. The substrate according to claim 7, wherein adjacent panel warp-yarns in a selected panel segment have different lengths from each other to form a non-uniform, longitudinal gap from an adjacent panel segment.

10. The substrate according to claim 1, wherein each of the segmented substrates defines a laterally innermost edge laterally spaced apart from a laterally outermost edge, and comprises a knitted construct having a plurality of knit rows extending from the laterally innermost edge to the laterally outermost edge.

11. The substrate according to claim 10, wherein each knit row corresponding to a panel segment is relatively longer in a lateral direction than each knit row corresponding to a region of the respective segmented substrate between adjacent panel segments.

12. The substrate according to claim 10, wherein each segmented substrate defines a continuous region positioned between the fastener elements and the juxtaposed panel segments, wherein each segmented substrate defines a gap between adjacent ones of the juxtaposed panel segments, wherein each knit row corresponding to a panel segment is relatively longer in a lateral direction than each knit row corresponding to the continuous region of the respective substrate.

13. The substrate according to claim 10, wherein each finished edge comprises a tie yarn.

14. The substrate according to claim 1, wherein one or both of the first panel and the second panel comprises a knitted, woven, or felted textile, a homogeneous panel, a non-homogeneous panel, or a combination thereof.

15. The substrate according to claim 1, wherein a gap extends longitudinally between each juxtaposed panel segment and each gap has a uniform longitudinal dimension.

16. The substrate according to claim 1, wherein a gap extends longitudinally between each juxtaposed panel segment and each gap has a non-uniform longitudinal dimension.

* * * * *